US005511276A

United States Patent [19]

Lee

[11] Patent Number: 5,511,276

[45] Date of Patent: Apr. 30, 1996

[54] TOOTHBRUSH WITH REPLACEABLE BRISTLE CARRIER

[76] Inventor: Kuo-Ming Lee, 12180 Ramona Ave. #12, Chino, Calif. 91710

[21] Appl. No.: 447,110

[22] Filed: May 22, 1995

[51] Int. Cl.[6] ..... A46B 9/04; A46B 5/02

[52] U.S. Cl. ..... 15/167.1; 15/143.1; 15/176.1; 15/176.6; D4/107

[58] Field of Search ..... 15/143.1, 167.1, 15/176.1, 176.4, 176.5, 176.6; D4/107, 124, 126, 138

[56] References Cited

U.S. PATENT DOCUMENTS

| | | | |
|---|---|---|---|
| D. 155,669 | 10/1949 | Zandberg | D4/107 |
| D. 209,574 | 12/1967 | Zandberg | D4/107 |
| D. 336,368 | 6/1993 | Bickell | D4/104 |
| 1,271,252 | 7/1918 | Wilson | 15/176.4 |
| 1,567,507 | 12/1925 | Howard | 15/176.1 |
| 1,908,511 | 5/1933 | Dodson | 15/176.1 |
| 2,668,973 | 2/1954 | Glaza et al. | 15/176 |
| 4,227,276 | 10/1980 | Ginsburg | 15/176 |
| 4,283,808 | 8/1981 | Beebe | 15/145 |
| 4,592,109 | 6/1986 | Borea | 15/176.1 |
| 4,654,922 | 4/1987 | Chen | 15/172 |
| 4,683,604 | 8/1987 | Rueb | 15/176 |
| 4,780,924 | 11/1988 | Hansen | 15/176.1 |
| 5,005,246 | 4/1991 | Yen-hui | 15/111 |
| 5,224,234 | 7/1993 | Arsenault | 15/167.1 |
| 5,247,718 | 9/1993 | Victorian | 15/167.1 |

FOREIGN PATENT DOCUMENTS

| | | | |
|---|---|---|---|
| 900692 | 1/1954 | Germany | 15/176.1 |
| 2014278 | 10/1971 | Germany | 15/176.1 |
| 24478 | of 1909 | United Kingdom | 15/176.1 |
| 2044089 | 10/1980 | United Kingdom | 15/176.1 |

*Primary Examiner*—Timothy F. Simone
*Assistant Examiner*—Randall E. Chin

[57] ABSTRACT

A toothbrush provided with a replaceable bristle carrier which is receivable within a bristle assembly retainer of a base member, the base member includes a handle and a retainer. The handle with a human-body shape can provide positive control during brushing. There is a latch mechanism to lock the bristle carrier into the retainer firmly. In the preferred embodiment, the latch mechanism includes a male latch portion or spring finger affixed to the bristle carrier, and a cavity defined within the retainer to receive the spring finger. In the alternative embodiment, the latch mechanism includes a male latch portion or latch bolt held by the base member, and a latch slot within the bristle carrier to receive the latch bolt. The bristle carrier is disposable and replaceable which may be detached from the handle when worn and replaced by a fresh set.

6 Claims, 3 Drawing Sheets

TOOTHBRUSH WITH REPLACEABLE BRISTLE CARRIER

BACKGROUND

1. Field of the Invention

The present invention relates to the field of hygienic cleaning apparatus, particularly apparatus which comes into contact with the human body. The invention is an improvement in oral hygiene apparatus, and especially an improvement in toothbrushes having a handle to allow the user to have positive control and saving effort of the brushing action, and more particularly which toothbrush having a replaceable and disposable bristle carrier when the bristles have worn out.

2. Description of Prior Art

Conventional style toothbrushes are commonly comprised of a brush handle with bristles planted on the front end of the brush handle. It has been suggested that a user replacing his toothbrush at least every two weeks on a regular basis, and more often in situations such as after surgery or while undergoing chemotherapy, will result in greatly reduced germ accumulation and transmission from a bacteria-encrusted toothbrush bristle. It is believed that after a short period of usage, the bristles of toothbrush become worn and softened. Then the toothbrush will be unable to clean the teeth thoroughly and may possible do injury to the gingiva. Therefore, when a toothbrush is worn out, one normally will discard it and buy a new one. However, to throw away a whole toothbrush is not economical. For cost saving, a toothbrush with replaceable bristle carrier can solve this problem.

The users only have to pay a fraction of the price of an entire one-piece conventional style toothbrush in order to replace the clean bristle carrier.

U.S. Pat. No. 4,227,276 discloses a toothbrush having a detachable and replaceable brush portion which is unsafe and uncomfortable to use because there is a very uncomfortable design in its first embodiment, which employs a knob near each of the two corners of one end of the bristle-bearing tray, the user will feel very uncomfortable and tend to hurt or even injure the mouse when in use. Besides there is another unsafe design in its second embodiment, it employs a rough and weak connection between the bristle-bearing tray and handle portion. The connection is not smooth enough for the user to clean the teeth safely, weak support on the connection also makes the user worry about when it will break during brushing action proceeding.

U.S. Pat. No. 5,224,234 discloses a two unit toothbrush having a handle portion and a detachable bristle unit. There is a mating nib and groove to secure the bristle unit to the handle portion in each of the embodiments. Using a force to lock the mating nib and groove together. The handle and the bristle unit are secured to each other by friction and/or clamping action. Mere frictional and/or clamping engagement is often insufficient to prevent undesirable separation of the bristle unit from the handle when the toothbrush is in actual use, because the toothbrush is used to brush teeth along all directions and the bristle unit is driven to rub against the resistance force imposed by the teeth during the brushing process.

Further, it would be desirable to have a toothbrush that provides for positive control and saving effort of the brushing action by mean of a handle that is designed to be comfortably held by the user, It would be desirable to have a toothbrush with an elegant and eye-pleasing appearance which can beautify our daily life. In addition, it would be desirable to have replaceable brush heads for the toothbrush to minimize disease transmission and the cost of the toothbrush to the consumer. The present invention provides such a toothbrush design.

The invented toothbrush is comprised of a handle portion and a replaceable bristle carrier. Through regular use of this style toothbrush and regular periodic replacement of the bristle carrier, bacteria accumulation will be reduced, and plaque build-up will be minimized. The regular use of this style toothbrush and replacement of the bristle carrier will decrease the risk of germ transmission that contributes to cavities and gum disease, and will promote a healthy mouth and a healthy body.

OBJECTS AND SUMMARY OF THE INVENTION

Accordingly, several objects and advantages of my invention are:

(a) to provide an improved toothbrush with replaceable bristle carrier wherein the latch mechanism between the handle and the bristle carrier is designed to prevent accidental separation of the bristle carrier from the handle while the toothbrush is in use;

(b) to provide an improved toothbrush with disposable bristle carrier;

(c) to provide an improved toothbrush, the handle of which can allow the user to have positive control and saving effort of the brushing action;

(d) to provide an improved toothbrush with an eye-pleasing and elegant appearance, which can be made of more durable materials suchlike metallic, resin, reinforced plastic and so forth;

(e) to provide a toothbrush assembly which has multiple bristle arrangements available, which will allow the user to change a different bristle configuration at any time;

(f) to provide an improved toothbrush, which has a very smooth joint between the bristle carrier and the handle to ensure the user against the discomfort and the danger;

(g) to provide an improved toothbrush, the regular use of which, along with regular replacement of bristle carrier, will reduce bacteria accumulation in the toothbrush and in the users mouth;

(h) to provide an improved toothbrush, the regular use of which will decrease the risk of germ transmission that contributes to development of cavities and gum disease;

(i) to provide an improved toothbrush, the regular use of which will minimize plaque build-up on the users teeth;

(j) to provide an improved toothbrush, the regular use of which will promote a healthy mouth and a healthy body; and (k) to provide an improved toothbrush, which is not only cheaper to make but also more durable to use than one-piece conventional style toothbrush.

Still further objects and advantages will become apparent from a consideration of the ensuing description and accompanying drawings.

The invention discloses a toothbrush comprised of a base member including a handle and a bristle carrier retainer, and a bristle carrier which mates with the base member. There is a latch mechanism to lock the bristle carrier into the retainer firmly which can prevent accidental separation of the bristle carrier from the handle while the toothbrush is in use. The handle with a human-body shape comprises an elongated neck affixed to the receptacle, a chest affixed to the neck, a waist affixed to the chest, and an elongated leg portion affixed to the waist.

The bristle carrier comprises a bristle holder symmetric about a longitudinal axis, a front end normal to the longitudinal axis, a rear end affixed by a spring finger with a locking tooth normal to the longitudinal axis, a top surface with embedded bristles, two sliding side surfaces depending perpendicularly downward from the top surface, two oppositely inclined sliding surfaces extending upwardly from the sliding side surfaces and away from the longitudinal axis, two oppositely slightly beveled sliding surfaces extending downwardly from the inclined sliding surfaces and close to the longitudinal axis, a flat bottom sliding surface fixed between the slightly beveled sliding surfaces, and a vertical stop surface connected vertically to the sliding side surfaces and the inclined sliding surfaces and the slightly beveled sliding surfaces and the flat bottom sliding surfaces simultaneously. The bristle carrier retainer affixed to the handle comprises a front end wall normal to a longitudinal axis, a rear end wall containing a male latch receiving portion normal to the longitudinal axis, a top plane surface normal to the rear end wall, two side walls depending perpendicularly downward from the top plane surface, two oppositely inclined side walls extending upwardly from the side walls and away from the longitudinal axis, two oppositely slightly beveled side walls extending downwardly from the inclined side walls and close to the longitudinal axis, and a flat bottom wall fixed between the slightly beveled side walls. The male latch receiving portion comprises a male latch receiving cavity which can contain the spring finger and snap the locking tooth, and releasing pin which can release the locking tooth. The bristle carrier and the receptacle provide seven surfaces of sliding contact upon mating of the parts.

BRIEF DESCRIPTION OF THE DRAWINGS

The foregoing and other objects will become more readily apparent by referring to the following detailed description and the appended drawings in which.

Figure 1:
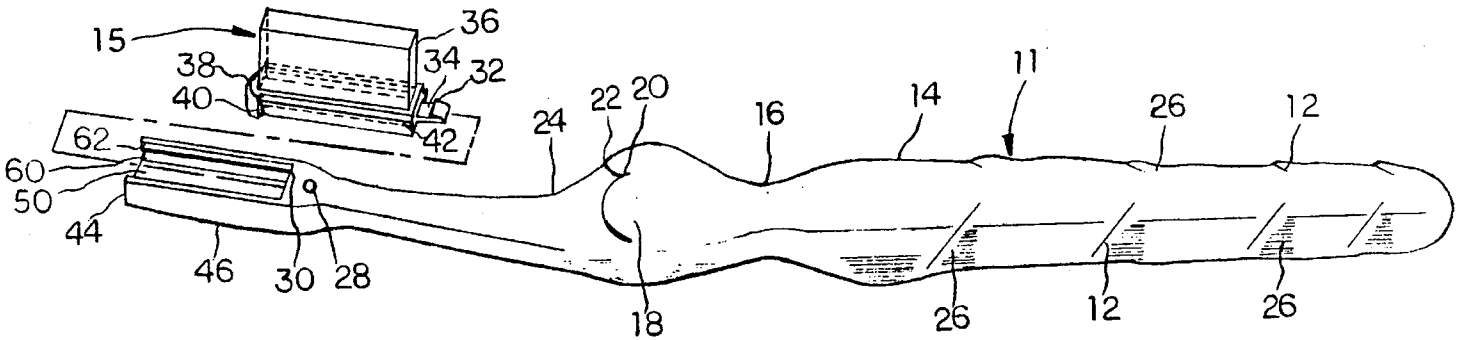
FIG. 1 is an exploded perspective view of a preferred embodiment of the present invention.

| Reference Numerals | |
|---|---|
| 11 base member | 46 retainer |
| 12 vein | 48 stop surface |
| 14 handle | 50 bottom surface |
| 15 bristle carrier | 52 cavity |
| 16 waist | 54 releasing pin |
| 18 chest | 56 ramp |
| 20 chest recess | 58 upward edge |
| 22 chest base | 60 upward side surface |
| 24 neck | 62 vertical side surface |
| 26 hollow | 64 bottom portion |
| 28 rubber membrane | 66 vertical edge |
| 30 beveled side surface | 68 latch slot |
| 32 locking tooth | 70 tenon |
| 34 spring finger | 72 latch bolt |
| 36 bristles | 74 mortise |
| 38 bristle holder | 76 spring holding pin |
| 40 vertical stop edge | 78 compression spring |
| 42 beveled edge | |
| 44 vertical end surface | |

PREFERRED EMBODIMENT—DESCRIPTION

Figure 5:
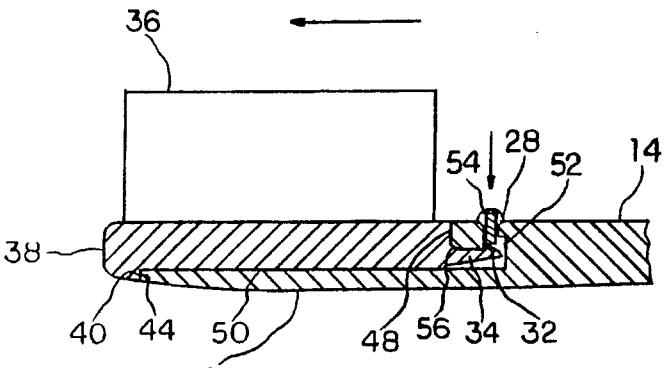
FIG. 5 is an enlarged side sectional view taken on lines 5—5 of FIG. 2.
Figure 6:
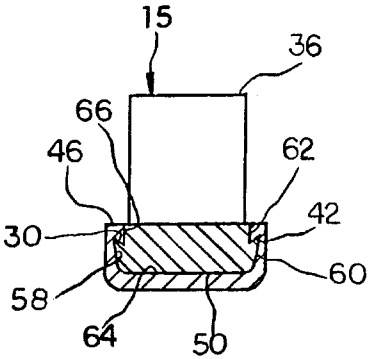
FIG. 6 is an enlarged end sectional view taken on lines 6—6 of FIG. 3.

Referring to FIG. 1 (exploded perspective view), the invented toothbrush apparatus includes two separable units, a base member 11 and a removable bristle carrier 15. The base member 11 includes an elongated handle 14 connected to a bristle assembly receiving portion or retainer 46, which has a recess on its underside for receiving the bristle carrier 15 therein. Referring to FIG. 6 (enlarged end sectional view), the recess is comprised of a preferably flat bottom surface 50, and an upward side surface 60 connected to an inclined or beveled side surface 30 connected to a vertical side surface 62 on the both sides parallel to a longitudinal axis, and a bristle assembly stop surface 48 and a vertical end surface 44 normal to the longitudinal axis of the base member 11. As shown in FIG. 5 (enlarged side sectional view), there is a latch receiving cavity 52 under the stop surface 48, through which there is a releasing pin 54 covered with a rubber membrane 28.

Figure 2:
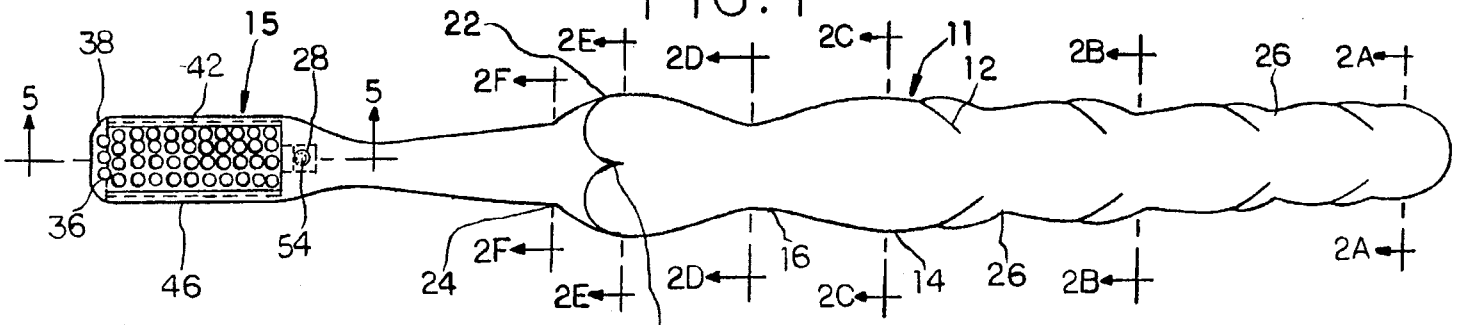
FIG. 2 is a top plan view of a preferred embodiment of the present invention.
Figures 2A, 2B, 2C, 2D, 2E, 2F:
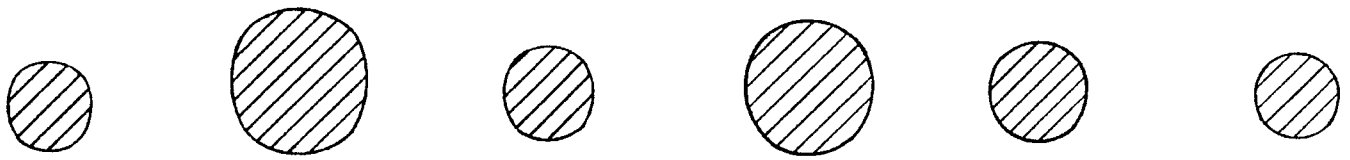
FIG. 2A–F show the cross-sectional shapes of the handle portion of the toothbrush of FIG. 2.
Figure 3:
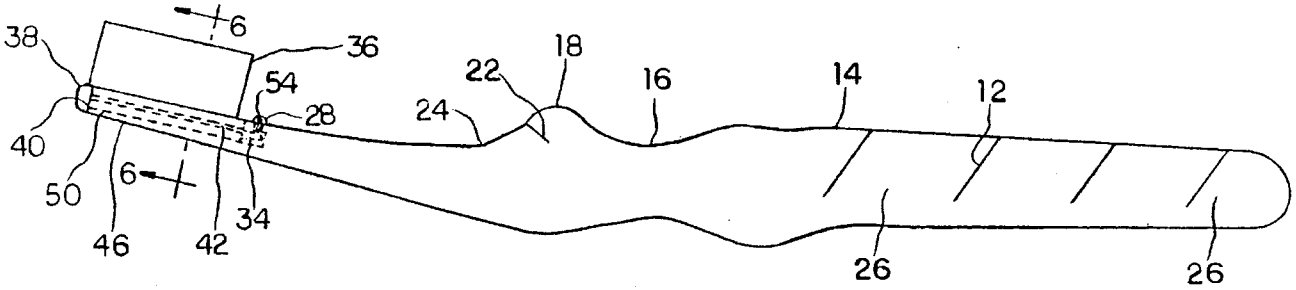
FIG. 3 is a front elevational view of a preferred embodiment of the present invention.
Figure 4:
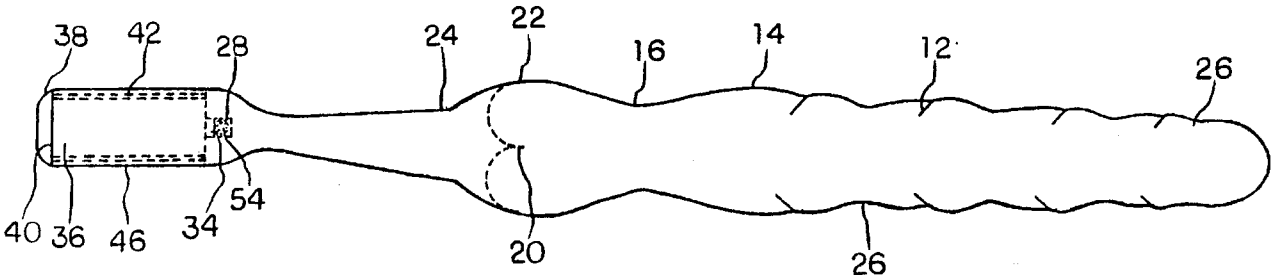
FIG. 4 is a bottom plan view of a preferred embodiment of the present invention.

Referring to FIG. 2 (top plan view), FIG. 3 (front elevation), and FIG. 4 (bottom plan view), the handle 14 has a human-body shape, which includes an elongated neck 24 connected to retainer 46, and a hill-like chest 18 connected to neck 24, and a valley-like waist 16 connected to chest 18, and an elongated leg portion with a vein 12 and a cave-like hollow 26 connected to waist 16. The chest 18 includes a chest base 22 around the lower base portion of chest 18, and a chest recess 20 on the center of the chest 18. The vein 12 and hollow 26 are not only used to beautify the appearance but also used to fit the shapes of the fingers and to increase the grasping friction. Referring to FIGS. 2A–F, there are shown the cross-sectional shapes of the handle 14 at several points along its length. From these views it can be seen that the handle 14 is a round trapezoid throughout its length. To improve the comfort when the handle 14 is grasped, the corners of the surface of the handle 14, both radially and axially, are rounded.

A replaceable and disposable toothbrush bristle carrier 15, as seen in FIG. 5 and FIG. 6, includes a bristle holder 38 into which bristles 36 are embedded by any desired means, and a spring finger 34 with a locking tooth 32 of which the lower sloped face advances as the male latch portion is inserted into the cavity 52 via a ramp 56. The bristle holder 38 includes a bottom portion 64, and a upward edge 58 connected to a beveled edge 42 connected to a vertical edge 66 on the both sides parallel to the longitudinal axis, and a vertical stop edge 40 connected to the bottom portion 64 normal to the longitudinal axis.

PREFERRED EMBODIMENT—OPERATION

As shown in FIG. 1, mating is accomplished by simply holding the handle 14 and sliding the replaceable bristle carrier 15 into the retainer 46, the bottom portion 64 and the upward edge 58 and the beveled edge 42 and the vertical edge 66 of bristle carrier 15 can match the corresponding bottom surface 50 and upward side surface 60 and beveled side surface 30 and vertical side surface 62 of retainer 46 precisely. When fully inserted, the locking tooth 32 snaps into the cavity 52 which pushes the releasing pin 54 up, and the vertical stop edge 40 contacts with the vertical end surface 44 closely and smoothly, and the spring finger bearing edge contacts with the stop surface 48. closely and smoothly whereupon the two units are fully mated and ready for use. All mating surfaces between the bristle carrier 15 and the base member 11 are well mated insuring that no side to side or rocking motion is created in the bristle holder 38 relative to the base when in use. This prevents damage to the teeth while the toothbrush apparatus is being used.

The surface of the joint between the base member 11 and the bristle carrier 15 is very smooth which ensures the user to operate it very comfortably and safely.

The handle 14 with human-body shape is ergonomically designed which can provide positive control and saving effort during brushing while being comfortable to grasp in numerous ways. To hold the handle 14, just use thumb and index finger to hold the waist 16 and the other fingers to hold the leg portion. It is so comfortable to grasp handle 14, because the handle 14 provides the hill-like chest 18 and the valley-like waist 16 which can be fitted by thumb and index finger perfectly and the cave-like hollow 26 which can be fitted by the other fingers perfectly.

To remove the replaceable bristle carrier 15, simply just use one hand to hold the base member 11 and press down the releasing pin 54, and pull out the bristle carrier 15 with the other hand slightly, then the two units are separated completely.

The mating surfaces of each unit preferably have a zero clearance tolerance between them, with the exception that the bottom surface 50 of the retainer 46 has a 0.002" clearance allowance and the waterproof rubber membrane 28 is well sealed which prevents water from entering the cavity 52. Water seepage between the two units is thus inhibited, and therefore the establishment of a bacteria breeding ground is avoided.

A coating of natural or synthetic rubber, or tetrafluoroethylene may be provided on the two mating surfaces of the units, which establishes a gasket-like seal.

ALTERNATIVE EMBODIMENTS—DESCRIPTION

Figure 7:
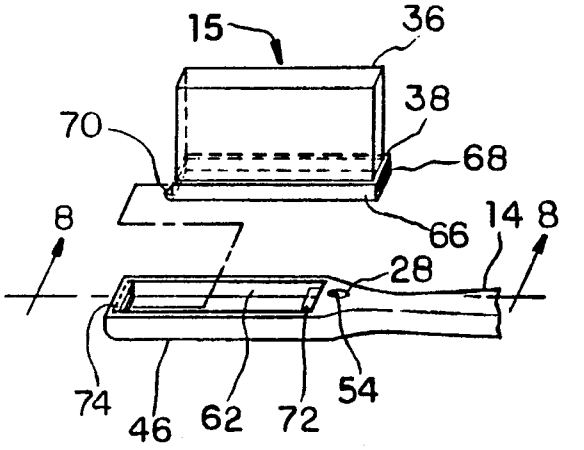
FIG. 7 is an exploded perspective view of an alternative embodiment of the present invention.
Figure 9:
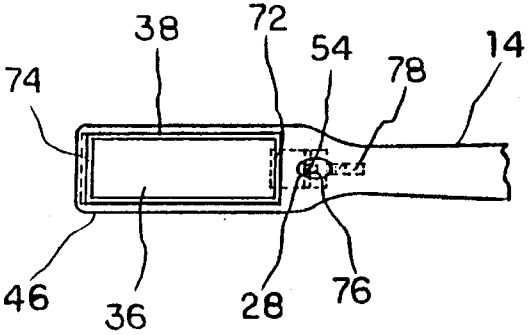
FIG. 9 is a top plan view of an alternative embodiment of the present invention.

Referring to FIG. 7 (exploded perspective view), the alternative embodiment of the present invention includes two separable units, a base member 11 and a removable bristle carrier 15. The base member 11 includes an elongated handle 14 with a human-body shape connected to a bristle assembly receiving portion or retainer 46, which has a recess on its underside for receiving the bristle carrier 15 therein. The recess is comprised of a preferable flat bottom surface 50 connected to a vertical side surface 62 on the both sides parallel to a longitudinal axis, and a stop surface 48 and a tenon receiving protion or mortise 74 normal to the longitudinal axis of the base member 11.

Figure 8:
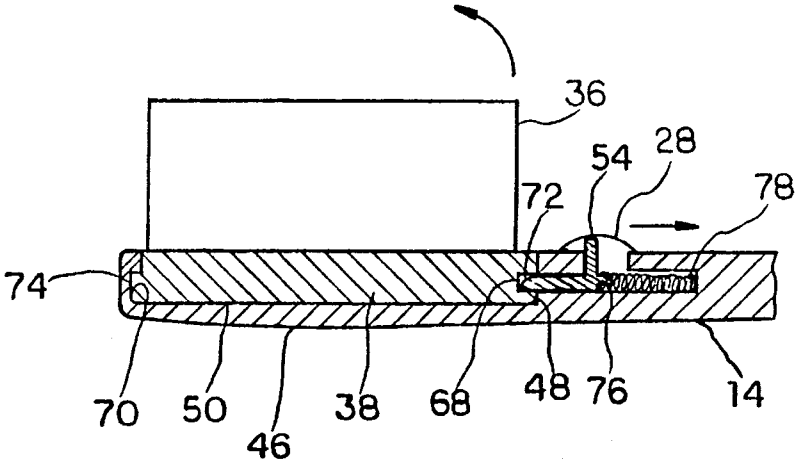
FIG. 8 is an enlarged side sectional view taken on lines 8—8 of FIG. 7.
Figure 10:
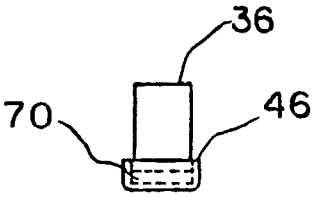
FIG. 10 is a left end elevational view of FIG. 9.

As shown in FIG. 8 (enlarged side sectional view), them is a latch bolt retaining cavity under the stop surface 48, which holds a latch bolt 72 with a releasing pin 54 which is covered with a rubber membrane 28 and a spring holding pin 76 which holds a compression spring 78.

A replaceable and disposable toothbrush bristle carrier 15, as seen in FIG. 7 and FIG. 8, includes a bristle holder 38 into which bristles 36 are embedded by any desired means. The bristle holder 38 includes a bottom portion 64, and a vertical edge 66 on both sides parallel to the longitudinal axis, and a latch slot 68 on a rear end and a tenon 70 on a front end normal to the longitudinal axis.

ALTERNATIVE EMBODIMENTS—OPERATION

While mating, just hold the bristle carrier 15 tilted at about 15 degree slope to the level, insert the tenon 70 into the mortise 74 completely, and push the rear end of the bristle holder 38 downward until the latch slot 68 is locked by the latch bolt 72. The edge between the rear end and the bottom portion 64 is slightly rounded, which is used to push the inclined tip of the latch bolt 72 backward easily. Whereupon the two units are fully mated and ready for use. All mating surfaces between the bristle carrier 15 and the base member 11 are well mated insuring that no side to side or rocking motion is created in the bristle holder 38 relative to the base when in use. This prevents damage to the teeth while the toothbrush apparatus is being used.

To remove the replaceable bristle carrier 15, simply just use one hand to hold the base member 11 and slide the releasing pin 54 backward until the latch bolt 72 leaves the latch slot 68, pull the rear end of the bristle holder 38 upward with the other hand, and the tenon 70 can be pulled out from the mortise 74 when the bottom surface 50 appears, then the two units are separated completely.

The mating surfaces of each unit preferably have a zero clearance tolerance between them, and the waterproof rubber membrane 28 is well sealed which prevents water from entering the cavity 52. Water seepage between the two units is thus inhibited, and therefore the establishment of a bacteria breeding ground is avoided.

A coating of natural or synthetic rubber, or tetrafluoroethylene may be provided on the two mating surfaces of the units, which establishes a gasket-like seal.

CONCLUSIONS, RAMIFICATIONS, AND SCOPE

Accordingly, it can be seen that the present invented toothbrush with replaceable and disposable bristle carrier, which has an eye-pleasing and elegant appearance, which can be made of more durable materials, the handle of which can allow the user to have positive control and saving effort of the brushing action. The latch mechanism between the handle and bristle carrier can prevent accidental separation of the bristle carrier from the handle while in use, the joint between the bristle carrier and the handle is so smooth which ensure the user against the discomfort and the danger.

The regular use of the invented toothbrush, along with regular replacement of the bristle carrier, will reduce bacteria accumulation in the toothbrush and in the user's mouth, will minimize plaque build-up in the user's teeth, will decrease the risk of germ transmission that contributes to development of cavities and gum disease, and will promote a healthy mouth and a healthy body.

As mentioned above, the handle is so well constructed, it can be used for many years so that it is worthwhile to make the handle of a rather expensive or reasonably expensive materials such as metallic, resin, reinforced plastic and so forth.

The improved toothbrush with replaceable bristle carrier is an invention of environmental conservation, because it can reduce a lot of plastic waste from using it, which is not only cheaper to make but also more durable to use than one-piece conventional style toothbrush.

Although the description above contains many specificities, these should not be construed as limiting the scope of the invention but as merely providing illustrations of some of the presently preferred embodiments of this invention. Various other embodiments and ramifications are possible within it's scope. For example, the invented toothbrush can be furnished with a set of bristle carriers, each of which may have various bristle arrangements, suchlike a first carrier with a round head can be provided with several bundles or bunches of relatively soft bristles, another carrier with a square head can have bristles which are reasonably stiff, and a further carrier with a triangular head can have bristles with different length forming a wave shape on the top of bristles.

Thus the scope of the invention should be determined by the appended claims and their legal equivalents, rather than by the examples given.

What is claimed is:

1. A toothbrush having detachable mated parts comprising:

an elongated handle, a one-piece bristle carrier including;

a bristle holder symmetric about the longitudinal axis of the handle, a front end normal to said longitudinal axis, a rear end normal to said longitudinal axis, a male latch portion attached perpendicularly to said rear end, a top surface with embedded bristles, two sliding side surfaces depending perpendicularly downward from said top surface, two oppositely inclined sliding surfaces extending upwardly from said sliding side surfaces and away from said longitudinal axis, two oppositely slightly beveled sliding surfaces extending downwardly from said inclined sliding surfaces and close to said longitudinal axis, and a flat bottom sliding surface fixed between said slightly beveled sliding surfaces, and;

a bristle carrier receptacle affixed to said elongated handle including;

a front end wall normal to the longitudinal axis of the handle, a rear end wall normal to said longitudinal axis containing a male latch receiving portion, a top plane surface normal to said rear end wall, two side walls depending perpendicularly downward from said top plane surface, two oppositely inclined side walls extending upwardly from said walls and away from said longitudinal axis, two oppositely slightly beveled side walls extending downwardly from said inclined side walls and close to said longitudinal axis, and a flat bottom wall fixed between said slightly beveled side walls;

wherein said bristle carrier and said receptacle provide seven surfaces of sliding contact when mating.

2. A toothbrush of claim 1, wherein said male latch portion comprises a spring finger with a locking tooth.

3. A toothbrush of claim 2, wherein said male latch receiving portion comprises a male latch receiving cavity which receives said spring finger and snaps said locking tooth, and a releasing pin which releases said locking tooth.

4. A toothbrush of claim 1, wherein said elongated handle provides substantially a human-body-like shape comprising an elongated neck affixed to said receptacle, a hill-like chest affixed to said neck, a valley-like waist affixed to said chest, and an elongated leg portion affixed to said waist.

5. A toothbrush of claim 4, wherein said male latch portion comprises a spring finger with a locking tooth.

6. A toothbrush of claim 5, wherein said male latch receiving portion comprises a male latch receiving cavity which receives Said spring finger and snaps said locking tooth, and a releasing pin which releases said locking tooth.

* * * * *